United States Patent [19]

Hansel et al.

[11] 4,298,044

[45] Nov. 3, 1981

[54] WOOD CHIPPER

[75] Inventors: Sydney Hansel, Arlington, Wash.; Thomas N. Baker, Thiensville, Wis.

[73] Assignee: The Filer and Stowell Company, Milwaukee, Wis.

[21] Appl. No.: 113,517

[22] Filed: Jan. 21, 1980

[51] Int. Cl.[3] ..... B27C 7/10

[52] U.S. Cl. ..... 144/176; 144/241; 241/92

[58] Field of Search ..... 241/92; 144/162 R, 176, 144/218, 323, 235, 241

[56] References Cited

U.S. PATENT DOCUMENTS

| | | | |
|---|---|---|---|
| 2,337,407 | 12/1943 | Ottersland | 144/176 |
| 2,697,557 | 12/1954 | Durkee | 241/92 |
| 2,712,904 | 7/1955 | Durkee | 144/176 |
| 2,922,590 | 1/1960 | Bland | 241/92 |
| 3,061,207 | 10/1962 | Clark | 241/92 |
| 3,280,865 | 10/1966 | Alexander | 144/218 |
| 3,356,114 | 12/1967 | Noel | 144/218 X |
| 3,542,302 | 11/1970 | Salzmann, Jr. | 144/176 X |
| 4,047,670 | 9/1977 | Svensson | 144/176 |
| 4,155,384 | 5/1979 | Svensson | 144/176 |

*Primary Examiner*—W. D. Bray

*Attorney, Agent, or Firm*—Woodford R. Thompson, Jr.

[57] ABSTRACT

A wood chipper embodying a pair of adjacent discs mounted in face-to-fact relation on a drive shaft for rotation therewith. The discs are secured to each other and have angularly spaced aligned passageways therethrough. A recess is provided in one disc at the trailing side of each angularly spaced passageway, as viewed in the direction of rotation. A knife holder mounted within each recess carries a knife which is retained by a knife clamp. Interlocking means between the clamp and the knife holder limits relative movement therebetween both axially and radially to maintain accurate location of the knives. The end of the knife holder removed from the aligned passageways is spaced from its disc to define a cavity which receives babbit. Also, the edge of the knife opposite its cutting edge is spaced from the knife holder and may have slots which extend at an angle relative to the cutting edge to define cavities which receive babbit. The inner surface of the knife clamp flares outwardly at an angle away from the cutting edge of the knife to press the clamp against the knife near the cutting edge thereof.

7 Claims, 9 Drawing Figures

FIG. 4
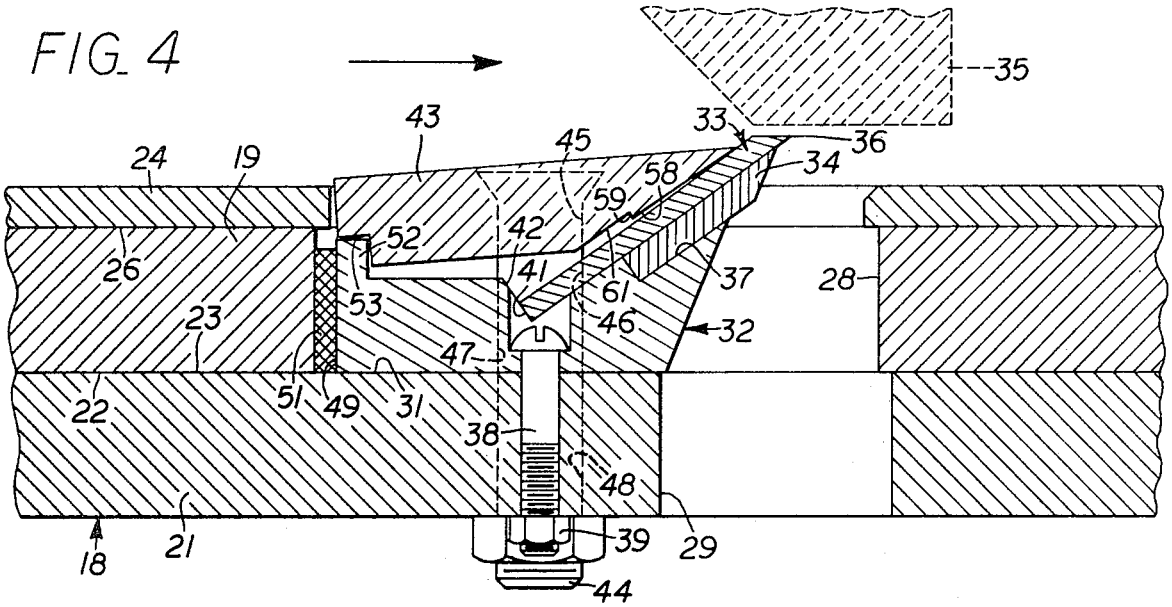
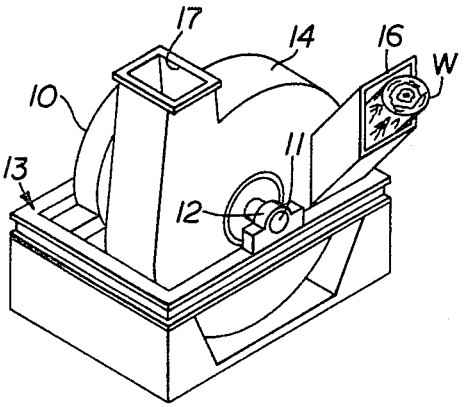
FIG. 1
FIG. 6
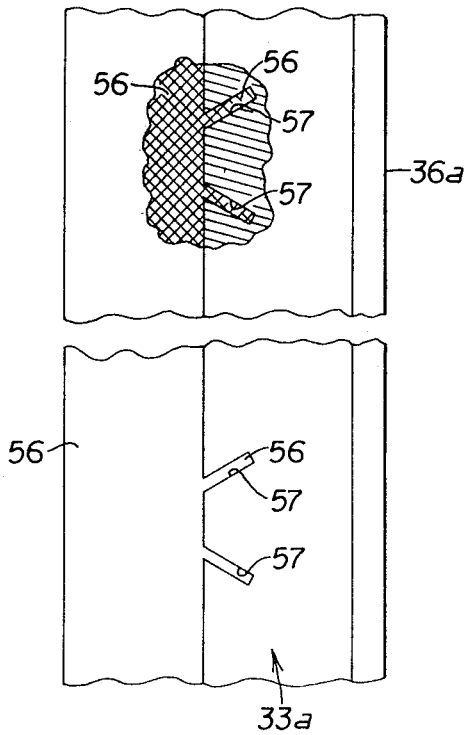
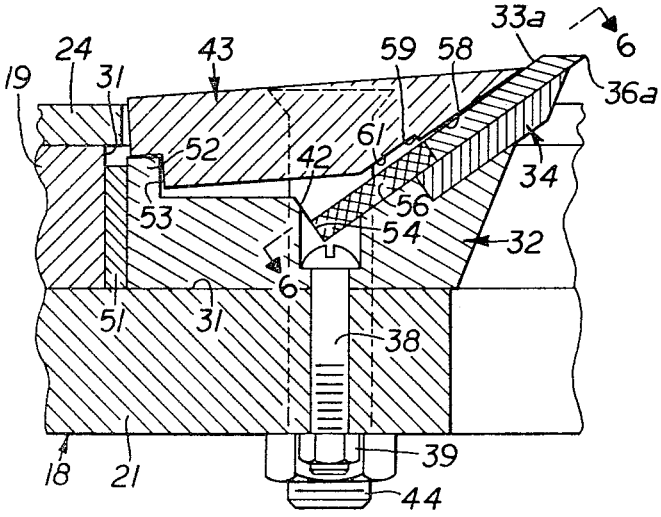
FIG. 5

FIG. 2
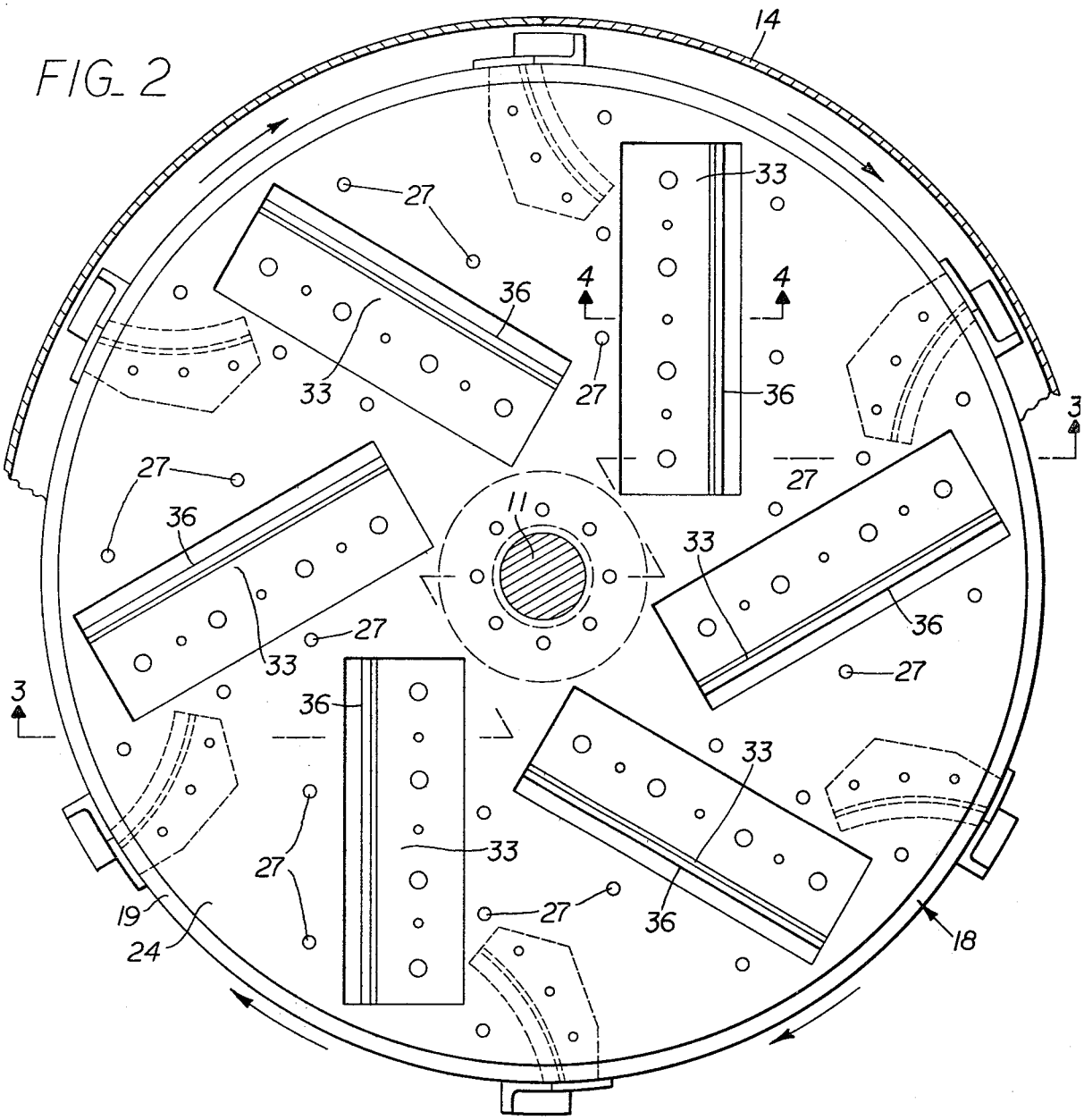
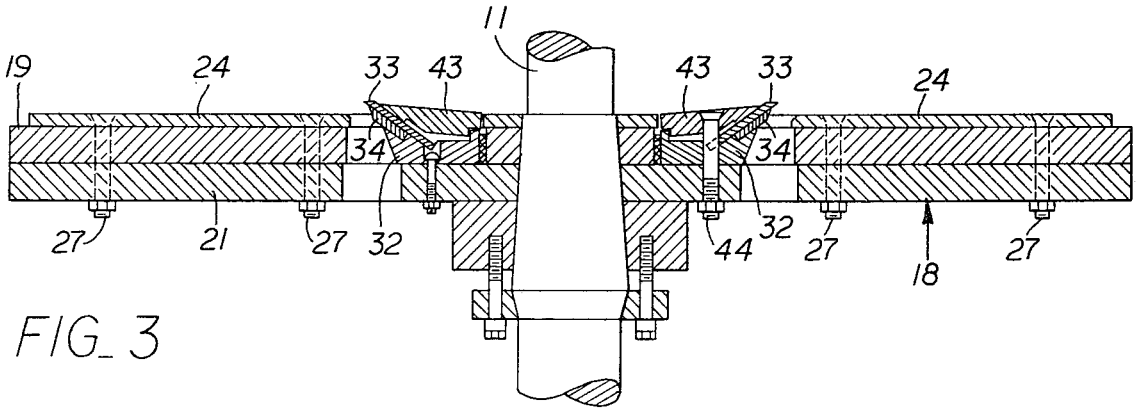
FIG. 3

WOOD CHIPPER

BACKGROUND OF THE INVENTION

This invention relates to a wood chipper and more particularly to a wood chipper which embodies a rotary disc unit having angularly spaced passageways therethrough with angularly spaced knives adjacent such passageways together with means for feeding wood to one side of the disc unit whereby the wood is cut into chips which pass through the passageways to the other side of the disc unit.

Heretofore in the art to which our invention relates, difficulties have been encountered in the manufacture of wood chippers due to the fact that the knife slots had to be machined to provide a smooth abutment surface for supporting the knife holder for taking the thrust of the knife and also for locating the knife holder accurately. The machining of the disc, including the knife slots, is very time-consuming and expensive. Also, difficulties have been encountered in mounting the knife holder accurately both radially and axially on the disc so as to preserve the relative accuracy required to insure that all of the knives are maintained in the proper position in all directions. Also, difficulties have been encountered in clamping the knife to the knife holder carried by the disc whereby the clamping means is pressed firmly against the knife adjacent the cutting edge of the knife. Furthermore, it has been difficult to adapt the knife clamp for use in clamping a knife which is thicker than the knife that the chipper was designed for. Our improved wood chipper is of the general type shown in the Eklund U.S. Pat. Nos. 3,276,700 and 3,410,495 and the Eklund et al U.S. Pat. No. 3,384,311.

SUMMARY OF THE INVENTION

To overcome the above and other difficulties, we provide a wood chipper which consists of a pair of adjacent discs mounted in face-to-face relationship on a drive shaft. The discs are secured rigidly to each other for rotation with the shaft and have angularly spaced aligned passageways therethrough. To mount the blades accurately on the disc unit and to retain the blades in proper relationship to each other at all times, we provide a recess in one disc at the trailing side of each angularly spaced passageway, as viewed in the direction of rotation of the disc unit. Mounted within each recess is a knife holder which carries a knife that is retained in place by a knife clamp. Interlocking means is provided between the knife clamp and the knife holder which limits relative movement therebetween both axially and radially. To eliminate expensive machining of the knife slots, the end of the knife holder removed from the aligned passageway adjacent thereto is spaced from its disc to define a cavity therebetween which receives a babbit-like metal. Accordingly, the knife slots may be flame cut without the necessity of expensive machining, thus greatly reducing the time and expense required in manufacturing the chipper. Also, by pouring a babbit-like metal between the knife holder and the disc, we provide effective means for taking the thrust of the knife and also locate the knife holder accurately. The edge of a knife opposite the cutting edge thereof is spaced from the knife holder and may have slots which extend at an angle relative to the cutting edge of the knife to define cavities which receive a babbit-like material to locate the knife accurately on the knife holder and to take the thrust of the knife. To insure that the knife clamp presses firmly against the knife near the cutting edge thereof, we provide an inner surface on the knife clamp which flares outwardly at a very small angle away from the cutting edge thereof to assure that, when the knife and clamp deflect slightly under the load tangential to the disc, this flared surface would then bear along its entire length on the knife.

DESCRIPTION OF THE DRAWINGS

A wood chipper embodying features of our invention is illustrated in the accompanying drawings, forming a part of this application, in which:

FIG. 1 is a perspective view of the wood chipper showing means for feeding wood to the chipper and means for discharging the chips therefrom;

FIG. 2 is an enlarged, vertical sectional view through the wood chipper showing the front face of the disc and a fragment of the outer housing for the chipper;

FIG. 3 is a vertical sectional view taken generally along the line 3—3 of FIG. 2;

FIG. 4 is an enlarged, fragmental sectional view taken along the line 4—4 of FIG. 2 showing a babbit-like metal poured between the knife holder and the disc element adjacent thereto;

FIG. 5 is a fragmental, sectional view corresponding to FIG. 4 showing a modification wherein a babbit-like metal is carried by a cavity located between the knife and the knife holder;

FIG. 6 is a view taken generally along the line 6—6 of FIG. 5 showing a fragment of the knife and the adjacent babbit-like metal in elevation, with parts in section and showing the slots in the blade which extend at an angle relative to the cutting edge of the knife and receive the babbit-like material;

DETAILED DESCRIPTION

Figure 9:
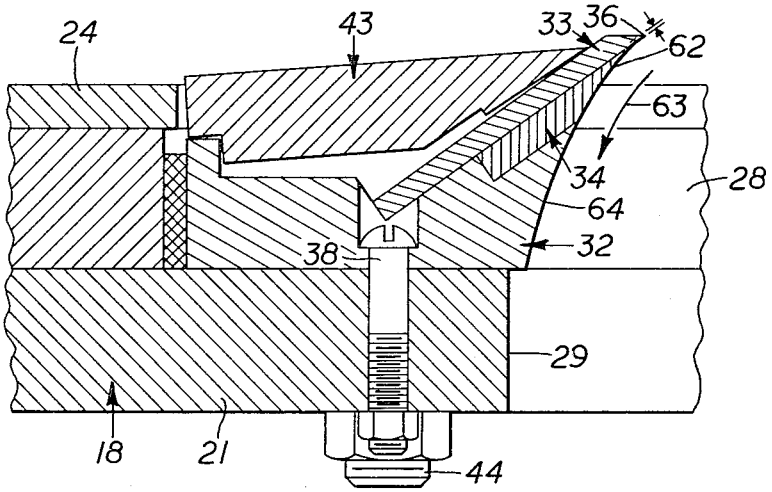

Referring now to the drawings for a better understanding of our invention, we show a power unit 10, such as an electric motor, having a drive shaft 11. Opposite ends of the drive shaft 11 are supported by suitable bearings 12 which are carried by a supporting housing 13 which includes an outer housing section 14. Communicating with the outer housing section 14 is a conventional type feed chute 16 for feeding wood W into the chipper. Also, a conventional discharge conduit 17 communicates with the housing section 14 for removing the chips from the chipper.

A disc unit 18 is mounted on and rotates with the drive shaft 11 and comprises a pair of disc elements 19 and 21. The inner surface 22 of the disc element 19 is mounted in face-to-face relationship with the inner surface 23 of the other disc element 21. Mounted in face-to-face relationship with the outer surface of the disc element 19 is a conventional wear plate 24. The engaging surfaces 22 and 23 of the disc elements 19 and 21 as well as the inner surface 26 of the wear plate 24 are ground to insure an accurate engagement along their inner faces. The disc elements 19 and 21 are secured to each other and to the wear plate 24 by suitable means, such as by bolts 27 and/or a suitable adhesive.

Angularly spaced, aligned passageways 28 and 29 are provided in the disc elements 19 and 21, respectively, the passageways 28 and 29 may be flame cut to assume the configuration shown in FIG. 4. The disc element 19 is cut away at the trailing side of each angularly spaced passageway 28, as viewed in the direction of rotation of the disc unit 18 to provide a recess 31 for receiving a knife holder 32 as clearly shown in FIGS. 4 and 5. A knife 33 is carried by each knife holder 32 adjacent the passageway 28, as shown. A suitable counter knife or wear plate 34 may be mounted beneath the knife 33 adjacent the cutting edge 36 thereof, as shown. A suitable recess 37 is provided in the knife holder 32 for receiving the counter knife 34 as shown in FIGS. 4 and 5. The knife holder 32 is secured to the disc element 21 by a suitable bolt 38 having a nut 39 at its lower end in position to engage the under surface of the disc element 21. The upper end of the bolt 38 may rest within a suitable recess provided in the knife holder 32. Also, as shown in FIGS. 4 and 5, the end 41 of the knife 33, which is opposite the cutting edge 36, is adapted to engage an inclined abutment member 42 whereby the knife holder 32 takes the thrust of the blade 33. A conventional anvil is shown at 35.

Mounted at the opposite side of each blade 33 from the knife holder 32 is a knife clamp 43 which is secured to the knife holder 32 and the disc element 21 by a bolt 44 which passes through suitable aligned passageways 45, 46, 47 and 48 provided in the clamp 43, knife 33, holder 32 and disc element 21, respectively, as clearly shown in FIG. 4.

The end 49 of the knife holder 32 which is removed from the aligned passageway 28 is spaced from the disc element 19 to define a cavity therebetween, as clearly shown in FIGS. 4 and 5. A babbit-like metal 51 is poured in this cavity to locate the knife holder 32 accurately and to take the thrust of the knife 33.

Interlocking means is carried by the knife clamp 43 and the knife holder 32 in position to engage each other and thus limit relative movement therebetween both axially and radially to maintain accuracy of the knives relative to each other in all directions. This interlocking means is shown as comprising a cooperating recess and projection between the knife clamp 43 and the knife holder 32 in portions thereof at the opposite side of the knife 33 from the side nearest the aligned passageway 28. The projection is shown as being an upstanding projection 52 carried by the knife holder 32 which engages an adjacent recess 53 provided in the knife clamp 43, as shown in FIGS. 4 and 5.

As shown in the embodiments of FIGS. 5 and 6, the knife **33*a* is shown as terminating in spaced relation to the abutment 42 carried by the knife holder 32 to define a cavity 54 therebetween which receives a babbit-like metal 56 which locates the knife accurately on the knife holder 32 and at the same time takes the thrust of the knife 33*a*. The embodiment shown in FIGS. 5 and 6 is identical to that shown in FIG. 4 with the exception of the blade 33*a* which terminates in spaced relation to the abutment 42 for receiving the babbit-like metal 56**.

Figure 7:
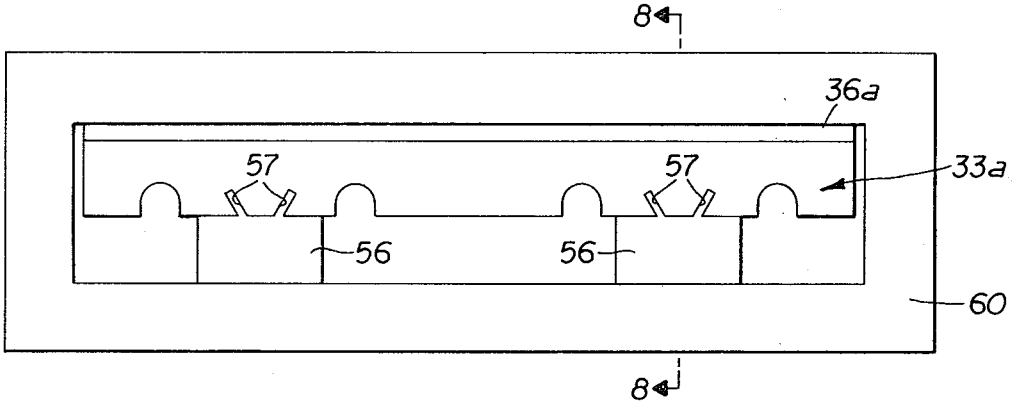
FIG. 7 is a side elevational view showing a jig which may be employed to bring the dimensions of a worn knife back to its original design width.
Figure 8:
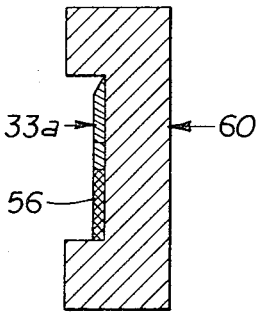
FIG. 8 is a sectional view taken generally along the line 8—8 of FIG. 7; and, FIG. 9 is a fragmental sectional view corresponding generally to FIG. 4 showing a modification wherein the chips are conveyed in a curved path.

As shown in FIGS. 6 to 8, slots 57 are provided in the blade **33*a* adjacent the cavity 54 and extend at an angle relative to the cutting edge 36*a* of the knife 33*a*. In the operation of the chipper the knife 33*a* will wear and its edge 36*a* may become chipped. During a knife change in the chipper the knives are removed, ground in a knife grinder and then placed in a suitable jig, such as the jig indicated at 60. With the knife in this jig, babbit metal 56 is poured to bring the dimensions of the knife back to its original design width. The amount of wear, damage or chipping may be different for each of the several knives and each will be placed individually in the jig 60** and each may receive a different amount of babbit metal. Accordingly, after the babbit metal cools, these knives will have their original shape and thus may be used again in the next knife change without readjustment when placed in the chipper.

As shown in FIGS. 4 and 5, the inner surface 58 of the knife clamp 43 adjacent the knife 33 or **33*a*, as the case may be, may flare outwardly at a slight angle of about 1/10th of a degree away from the cutting edge 36 or 36*a*, as the case may be. Accordingly, upon movement of the knife clamp 43 toward the knife, the knife clamp 43 is pressed firmly against the knife near the cutting edge thereof as the flared surface 58 bears along its length on the knife. A portion 59 of the knife clamp 43 which engages the knife 33 or 33*a*, as the case may be, projects beyond an adjacent undercut portion 61 on the knife clamp 43, as shown in FIGS. 4 and 5 whereby the portion 59 of the clamp 43 projecting beyond the undercut portion 61 can be machined back to accomodate a thicker knife. For example, we have found that the portion 59 of the knife clamp 43 may project approximately 3/16ths of an inch beyond the undercut portion 61**.

In FIG. 9 we show a further modification of our invention wherein the surface 62 of each counter knife or wear plate 34 adjacent its chip discharge slot is curved, as shown, so that the chips are directed in a curved path upon leaving the cutting edge 36, as indicated by the arrow 63. The knife rest or holder 32 may have an outer curved surface 64 which also directs the chip in a curved path so as to provide a continuation of the curved path of movement of the chips through the chip discharge slot or opening 28. By thus providing a curved path of movement, each chip would not progress through its slot in a series of jerks with two or more changes in direction. Accordingly, fragmentation and damage to the chips would be reduced to a minimum whereby there would be fewer "fines" or powdery chips. Preferably, there should be a small positive overlap of the knife edge of approximately 0.005 inches, as indicated in the drawing. The embodiment shown in FIG. 9 is identical to that shown in FIG. 4 with the exception of the curved surfaces 62 and 64 which bring about a curved path of movement of the chips through the slots.

From the foregoing, it will be seen that we have devised an improved wood chipper. By providing interlocking means between the knife clamp and the knife holder which limits relative movement therebetween both axially and radially, we maintain accuracy of the knives relative to each other in all directions and at the same time greatly simplify the construction of the knife clamp and knife holder. Also, by providing retaining bolts which extend through aligned openings through the knife clamp, knife holder and the disc element 21, additional means other than the bolts 38 is provided for securing the knife holder 32 to the disc element 21. Also, by providing the cavities between the knife holder 32 and the disc element 19 and between the abutment 42 of the knife holder 32 and the knife 33 or **33*a* which receives the babbit-like metal, we locate the knife and the knife holder accurately and at the same time the babbit-like metal takes the thrust of the knife. Furthermore, by providing an inner surface on the knife clamp 43 which flares outwardly at a slight angle away from the cutting edge of the knife, the knife clamp 43 is pressed firmly against the knife near the cutting edge thereof upon tightening the nuts 45 for the bolts 44. Furthermore, by providing the projection 59 on the knife clamp 43 beyond the adjacent undercut portion 61, the portion 59** may be machined back to accomodate a thicker knife, if desired.

While we have shown our invention in several forms, it will be obvious to those skilled in the art that it is not so limited, but is susceptible of various other changes and modifications without departing from the spirit thereof.

What we claim is:

1. A wood chipper comprising, (a) a drive shaft mounted for rotation in a supporting housing, (b) a disc unit having a pair of adjacent disc elements mounted on said drive shaft for rotation therewith the inner surface of one said disc element in face-to-face relationship with the inner surface of the other said disc element, (c) means securing said one disc element to said other disc element, (d) angularly spaced aligned passageways through said one disc element and said other disc element, (e) there being a recess in said one disc element at the trailing side of each angularly spaced passageway therethrough as viewed in the direction of rotation of said disc unit, (f) a knife holder mounted within each said recess in said one disc element with the end of said knife holder removed from said aligned passageways being spaced from said one disc element to define means therebetween for receiving a babbit-like metal that accurately locates said knife holder and limits movement thereof, (g) means securing said knife holder to said other disc element, (h) a knife carried by each said knife holder adjacent said aligned passageways with the edge of said knife opposite its cutting edge engaging an abutment carried by said knife holder so that said knife holder takes the thrust of said knife, (i) a knife clamp at the opposite side of said knife from said knife holder, (j) means connecting said knife clamp to said knife holder to secure said knife therebetween, (k) interlocking means carried by said knife clamp and said knife holder engaging each other and limiting relative movement therebetween both axially and radially to maintain accuracy of the knives relative to each other in all directions, and (l) means to feed wood to one side of said disc unit so that the wood is cut into chips which pass through said aligned passageways to the other side of said disc unit.

2. A wood chipper as defined in claim 1 in which said interlocking means carried by said knife clamp and said knife holder comprises at least one cooperating recess and projection between said knife clamp and said knife holder in portions thereof at the opposite side of said knife from the side thereof nearest said aligned passageways.

3. A wood chipper as defined in claim 2 in which said projection is carried by said knife holder in position to engage an adjacent recess in said knife clamp.

4. A wood chipper as defined in claim 1 in which said means connecting each said knife clamp to its knife holder comprises a retaining bolt extending through aligned openings through said knife clamp, said knife holder and said other disc element.

5. A wood chipper as defined in claim 1 in which an edge of said knife opposite the cutting edge thereof is in spaced relation to said knife holder to define a cavity therebetween and a babbit-like metal is carried by said cavity to locate said knife accurately on said knife holder and to take the thrust of said knife.

6. A wood chipper as defined in claim 1 in which slots are provided in said blade adjacent said cavity and extend at an angle relative to the cutting edge of said knife and said slots carry said babbit-like metal.

7. A wood chipper as defined in claim 1 in which the inner surface of said knife clamp adjacent said knife flares outwardly at a slight angle away from the cutting edge of said knife so that upon movement of said knife clamp toward said knife the knife clamp is pressed firmly against said knife near the cutting edge thereof.

* * * * *